US005474788A

United States Patent [19]

Lynch

[11] Patent Number: 5,474,788

[45] Date of Patent: Dec. 12, 1995

[54] FROTH ACCOMMODATING BEVERAGE CONTAINER

[75] Inventor: Francis J. Lynch, Glenageary, Ireland

[73] Assignee: Guinness Brewing Worldwide Limited, London, United Kingdom

[21] Appl. No.: 348,766

[22] Filed: Dec. 2, 1994

Related U.S. Application Data

[63] Continuation of Ser. No. 83,656, Jun. 28, 1993, abandoned.

[30] Foreign Application Priority Data

Jun. 30, 1992 [GB] United Kingdom ..... 9213914

[51] Int. Cl.[6] ..... B65D 25/08

[52] U.S. Cl. ..... 426/112; 426/115; 426/131; 220/906; 220/501; 220/505

[58] Field of Search ..... 426/112, 115, 426/124, 131, 113, 120, 107, 394, 407; 220/906, 23.83, 23.86, 501, 502, 505, 506, 528, 575, 554, 906; 206/219, 221; 215/6

[56] References Cited

U.S. PATENT DOCUMENTS

| | | | |
|---|---|---|---|
| 3,386,837 | 6/1968 | Arnot . | |
| 3,645,284 | 2/1972 | Krezanoski et al. | 220/23.83 |
| 3,694,235 | 9/1972 | Siegel . | |
| 4,399,158 | 8/1983 | Bardsley et al. . | |
| 4,832,968 | 5/1989 | Forage et al. | 426/112 |
| 4,996,823 | 3/1991 | Byrne | 426/115 |
| 5,196,216 | 3/1993 | Lynch et al. | 426/112 |
| 5,231,816 | 8/1993 | Lynch et al. | 220/906 |
| 5,290,574 | 3/1994 | Jamieson et al. | 426/112 |
| 5,340,595 | 8/1994 | Cameron-Price | 426/115 |

FOREIGN PATENT DOCUMENTS

| | | | |
|---|---|---|---|
| 2211479 | 7/1989 | United Kingdom . | |
| 9113006 | 9/1991 | WIPO | 220/906 |
| 9113007 | 9/1991 | WIPO | 220/906 |

*Primary Examiner*—Stephen J. Castellano
*Attorney, Agent, or Firm*—McCormick, Paulding & Huber

[57] ABSTRACT

A beverage package and a method of packaging a beverage such as beer containing gas in solution has a container can 1 having a primary chamber 1A charged with beer 14 to form a small headspace 15. The can 1 is sealed and includes a submerged insert 8 forming a relief chamber 6 which is sealed by a closure 11. The insert 8 is responsive to heat applied during pasteurization which causes the closure 11 to open the relief chamber so that the latter can accommodate beer derived from the primary chamber 1A to provide an enlarged headspace 15A. The small headspace 15 initially provided facilitates removal of air therefrom prior to sealing of the container while the enlarged headspace 15A is adequate to accommodate froth or foam developed by the intentional liberation of gas from solution in the beer. An insert part 7 forming a secondary chamber 5 may be provided for injecting gas or liquid into the beer to liberate gas therefrom for froth or foam development in the enlarged headspace. The relief chamber 6 may contain gas under pressure so that when opened to the primary chamber the release of such gas pressurizes the enlarged headspace 15A. The insert part 7 may be located within the relief chamber 6.

21 Claims, 4 Drawing Sheets

FROTH ACCOMMODATING BEVERAGE CONTAINER

This is a continuation of application Ser. No. 08/083,656, filed on Jun. 28, 1993, now abandoned.

TECHNICAL FIELD & BACKGROUND ART

The present invention relates to a beverage package and a method of packaging a beverage. It particularly concerns beverages having in solution gas, typically nitrogen and/or carbon dioxide, which is to be liberated to develop a head of foam or froth on the beverage for consumption.

The invention was primarily developed for the packaging of fermented beverages such as stout, lager, ale (or other beer) or cider although it is to be realised that it can be applied to the packaging of other alcoholic beverages, such as spirits and wines, or to non-alcoholic beverages such as so-called soft drinks, milk shakes and the like. In the packaging of beverages in a sealed container such as a can or bottle it is recognised that the presence of air or oxygen, particularly in a headspace of the container, can cause oxidation of the beverage and consequential adverse changes in its desirable characteristics (such as in the taste, bouquet or mouth feel). The presence of oxygen in close proximity with a beverage, even in relatively minute proportions of volume of oxygen to volume of beverage, can drastically shorten the shelf life of a sealed beverage package. Consequently, considerable care and measures are taken in beverage filling lines, particularly for beer, in an attempt to remove air from the container prior to sealing or to ensure that the air/beverage ratio is at an acceptably low level consistent with achieving a desired shelf life for the package. A sealed package for beer desirably has a shelf life in the order of 10 to 12 months so that at any time during that period a consumer opening the package can expect a product which is substantially consistent in its desirable characteristics.

Many beverage packaging techniques have been developed and incorporated in container filling lines to alleviate oxygen contamination by the presence of air in the container when sealed. Conventional techniques include purging the empty container of air with nitrogen or other non-oxidising gas, charging the container with beverage and thereafter taking steps to alleviate the entry of air into the headspace which is formed prior to the container being sealed. These latter steps can include, for example, filling the container headspace with froth or foam to displace air therefrom, dosing the headspace with liquid nitrogen so that nitrogen gas evolves and displaces air from the headspace or directing nitrogen gas under pressure into the headspace as the container is capped or sealed.

A beverage package which has achieved considerable commercial success is that in which, upon opening the sealed container, gas in solution from the beverage is intentionally liberated within the container to develop froth or foam in the container headspace. This purposeful liberation of the gas, particularly nitrogen, in solution may be achieved by many techniques which we have developed and are now well known in the art. For example, the beverage can be subjected to ultrasonic stimulation or to an externally developed jet of gas or liquid (conveniently applied from a syringe) in accordance with the disclosure in our British Patent No. 1,588,624 or an internally developed liquid (beverage) and/or gas stream may be injected into the beverage in accordance with the disclosure in our British Patent No. 2,183,592A.

In beverage packages in which the gas in solution is intentionally liberated to form froth or foam in the headspace when the sealed container is opened, it is usual to ensure that the headspace is of an adequate size to accommodate the froth or foam which will develop (or which will develop in a reasonable time prior to the beverage being poured from the container, say into a drinking vessel) so that the likelihood of the froth or foam bubbling out of the container and the beverage thereby being wasted is alleviated. It is common practice therefore that the volume of the headspace of a container in which the gas in solution is, or is to be, intentionally liberated on opening the container is considerably greater than the headspace of a beverage container in which it is not intended that the gas in solution should be liberated purposely within the container. In a typical example, a beverage can containing 500 milliliters of beer having gas in solution which is not intended to be intentionally liberated on opening of the container may have a small headspace or vacuity in the order of 27 milliliters (in practice this means that with a conventionally proportioned beer can the headspace has a depth of approximately 8 millimeters). In comparison a similarly dimensioned beverage can may contain 450 milliliters of beer having gas in solution which is to be liberated intentionally within the can on opening so that its headspace is relatively large, say with an approximate volume of 70 milliliters and a depth of approximately 20 millimeters.

With conventional containers having small sized headspaces as aforementioned, the removal and/or exclusion of air/oxygen from the headspace prior to sealing can be achieved in a relatively simple and efficient manner on a high speed container filling and sealing line simply by blowing nitrogen gas across or through the headspace prior to and as the container is sealed. However, with packages having the relatively large volume and deep headspace as aforementioned, simple blowing with nitrogen gas has been found unacceptable to ensure adequate removal of air/oxygen from the sealed container. Consequently to achieve this latter aim it is usual to employ additional de-gassing techniques and a currently popular air/oxygen purging step is to introduce a dose of liquid nitrogen into each container in the packaging line. The nitrogen gas which evolves from the dose displaces air from, and alleviates the entry of air into, the headspace so that such air/oxygen as may remain in the headspace is within acceptable tolerances as the container is sealed. The liquid nitrogen dose may also serve to pressurise the contents of the container when the latter is sealed. However, liquid nitrogen dosing is an expensive facility in a packaging line both in installation costs and running/consumable costs. Also it is disadvantageous in so far as it restricts the speed at which a packaging line can run and it is difficult to ensure, on a continuously moving line of containers, that the dose of liquid nitrogen which is introduced into the headspace of each container is consistent within predetermined tolerances (so that if the liquid nitrogen dose serves to pressurise the container when sealed, it is difficult to maintain consistency in the internal pressures of the sealed containers which issue from the packaging line). It is an object of the present invention to provide a beverage package and a method of packaging a beverage in which the beverage in the package contains gas in solution that is intentionally or purposely to be liberated to form froth or foam in a relatively large headspace of the container and which lends itself to alleviating the difficulties associated with conventional packaging techniques as discussed above.

STATEMENTS OF INVENTION & ADVANTAGES

According to the present invention there is provided a beverage package comprising a sealed container having a primary chamber accommodating beverage having gas in solution and which gas is to be liberated to provide froth or foam in a headspace of the primary chamber, and a relief chamber which is closed to communication with the beverage in the primary chamber when the container is sealed and is openable subsequent to said sealing whereby, on opening said relief chamber, a proportion of beverage derived from the primary chamber is accommodated in the relief chamber to enlarge said headspace for accommodating froth or foam developed therein.

Further according to the present invention there is provided a method of packaging a beverage having gas in solution which comprises providing a container with a primary chamber and a relief chamber which is closed to the primary chamber, charging the primary chamber with the beverage and sealing the container to form a headspace in the primary chamber and, subsequent to said sealing, opening the relief chamber to accommodate beverage derived from the primary chamber and thereby enlarge the headspace in the primary chamber for accommodating froth or foam developed by liberation of gas from the beverage.

The relief chamber may be constructed integral with the container but more usually it will be formed as a hollow insert, typically of plastics, which is located within the container. Initially the relief chamber will be sealed or otherwise closed to communication with the primary chamber and will usually contain nitrogen gas (although other appropriate non-oxidising gas as will be known in the beverage packaging art may be used). With the relief chamber closed to communication with the primary chamber, the latter is charged with beverage to provide a relatively small volume headspace. This headspace can be relatively shallow or even negligible in size so that it is easily purged of atmospheric oxygen, for example by a conventional degassing technique where nitrogen or other non-oxidising gas under pressure is blown across the headspace prior to and during sealing of the container. After the container is sealed, the relief chamber is opened to communication with the primary chamber so that beverage from the latter enters the relief chamber and thereby causes an increase in the volume of the headspace in the primary chamber; such gas as may be in the relief chamber is released into the beverage and into the headspace. A larger volume headspace is now available to accommodate froth or foam which will be developed by the intentional liberation of gas, typically nitrogen, from the beverage. Understandably the increased volume headspace has to be available to accommodate the froth or foam created when the container is opened to dispense the beverage for consumption. Preferably therefore the relief chamber is opened to accommodate beverage from the primary chamber subsequent to the sealing of the container and prior to the container being opened for beverage dispensing. It is possible however for the relief chamber to be opened to communicate with and accommodate beverage from the primary chamber substantially simultaneously with the opening of the container for beverage dispensing. It will be apparent from the aforegoing that the beverage package and the method of packaging of the present invention may permit the relatively small headspace which is initially provided to be purged efficiently of air/oxygen on conventional high speed container beverage filling and sealing lines while providing the advantage of a relatively large headspace to accommodate froth or foam derived by gas which is intentionally liberated from the beverage on opening the container.

It is most desirable that the relief chamber is arranged so that when it has opened to accommodate beverage from the primary chamber, the beverage from the relief chamber will be dispensed together with the beverage from the primary chamber when, for example, the beverage in the container is poured into a drinking vessel, thereby ensuring that the beverage in the relief chamber is not wasted.

In the preferred arrangement in which the relief chamber is opened to the primary chamber prior to the container being opened to dispense the contents, the relief chamber may have a closure which responds to a treatment of the sealed beverage package (for example from heat applied during pasteurisation) that causes the closure to open the relief chamber to the primary chamber. For example the relief chamber or a relevant part thereof may be formed of a plastics material the dimensions of which undergo a change (such as with heat shrink plastics) during pasteurisation and which change is adequate to open, or permit opening of, the closure. A further example may have the closure in the form of a bursting sheet/disc or a press fit cap which is subjected to a pressure differential between that in the relief chamber and that in the primary chamber (for example created as a result of the package passing through a pasteurisation process) and which is adequate to cause the sheet/disc to burst or the cap to be displaced to open the relief chamber for the accommodation of beverage. In achieving this latter technique a non-return valve may be provided in the relief chamber so that a pressure increase in the primary chamber (for example, developed during pasteurisation) is transmitted, by way of the non-return valve, into the relief chamber and upon cooling of the container (following pasteurisation) the pressure in the primary chamber may reduce at a greater rate than that in the relief chamber so creating a pressure differential which is adequate to open the closure of the relief chamber. The closure when opened desirably maintains its open condition and preferably remains secure in the container (to ensure that it is not dispensed along with the beverage). It will be appreciated that many techniques may be employed for opening the relief chamber within the sealed container as an alternative to a reaction created by heat, for example the relief chamber may be arranged to open in response to ultrasonic stimulation or other vibration or external mechanical manipulation of the container, for example by peristalsis or centrifugal force.

Where the relief chamber is arranged to open to communication with the primary chamber substantially simultaneously with the opening of the container for dispensing of the beverage, a simple mechanical link may be provided between the means whereby the container is opened (such as a rip-off or displaceable tab which is conventional for a beverage can top) and a closure for the relief chamber.

It is usual for beverage packages of the kind to which the present invention relates to have the headspace of the sealed primary chamber pressurised with a non-oxidising gas, typically nitrogen as previously discussed. A facility afforded by the invention is that the closed and sealed relief chamber can contain nitrogen (or other appropriate non-oxidising gas) under pressure so that when that chamber opens to communication with the primary chamber the gas which it releases pressurises the headspace and contents of the container as required. This has the advantage that the container can be sealed following the beverage charge and with its small headspace at relatively low pressure (thereby alleviating the requirement for liquid nitrogen dosing to pressurise the container contents to a relatively high pressure).

The intentional liberation of gas from solution in the beverage in the container to develop froth or foam in the enlarged headspace may be achieved by means applied externally of the container, such as by the ultrasonic stimulation of the beverage or the introduction of a gas or liquid jet into the beverage from a syringe as discussed in our British Patent No. 1,588,624. Preferably however, the beverage package of the present invention includes means which is responsive to a pressure differential created by opening of the sealed container for liberating gas from solution in the beverage to form froth or foam in the headspace of the primary chamber. The froth or foam developing means may comprise a secondary chamber from which liquid and/or gas is injected by way of a small aperture or non-return valve into the beverage in the container for the purpose of liberating gas from solution in the beverage in accordance with the disclosure in our British Patents Nos. 1,266,351 and 2,183,592A. The secondary chamber may be formed as a hollow insert similar to the disclosure in our British Patent No. 2,183,592A and both this chamber and the relief chamber may be formed as plastics mouldings. The secondary chamber may be discrete from the relief chamber although when these chambers are formed as plastics inserts they may be coupled or moulded together as a unified insert structure for convenience of being located and secured in the container. The secondary chamber may be disposed relative to the relief chamber so that the former acts, in response to the pressure differential as aforementioned, initially to liberate gas from solution in the beverage which is accommodated in the relief chamber. With this latter arrangement in mind the secondary chamber can be located within the closed or sealed relief chamber; this is convenient when the relief chamber is a hollow plastics insert which can readily be fitted and secured in the container so that the relief chamber carries with it the secondary chamber. By having the relief chamber and the secondary chamber in the form of an insert structure (or as inserts) they can be purged of atmospheric oxygen and gasified (and if required pressurised with nitrogen or other non-oxidising gas) remote from the container so that they can merely be inserted into the container on a filling line to alleviate the requirement for specialised facilities on the filling line for purging air from the container and relief chamber (and the secondary chamber when provided) prior to the container receiving its beverage charge. The proposal in which the secondary chamber is located within, or to react in, the relief chamber is particularly beneficial since it permits the two chambers to be purged of air, pressurised with nitrogen (or other appropriate non-oxidising gas) and sealed to atmosphere by sealing the openable relief chamber prior to the relief chamber and secondary chamber being located as a unified insert in the container, thereby alleviating the possibility of either chamber being contaminated with atmospheric oxygen.

DRAWINGS

Embodiments of a beverage package and method of packaging a beverage in accordance with the present invention will now be described, by way of example only, with reference to the accompanying illustrative drawings in which:

FIG. 1 diagrammatically illustrates one embodiment of the beverage package in a condition immediately following sealing of the container to provide a relatively small headspace;

FIG. 2 shows the package of FIG. 1 in a subsequent stage of processing in which the relief chamber as opened to accommodate beverage from the primary chamber to develop a relatively larger headspace, and FIGS. 3 to 8 show further embodiments of the beverage package in similar process stages to the package shown in FIGS. 1 and 2 respectively.

DETAILED DESCRIPTION OF DRAWINGS

Figure 6:
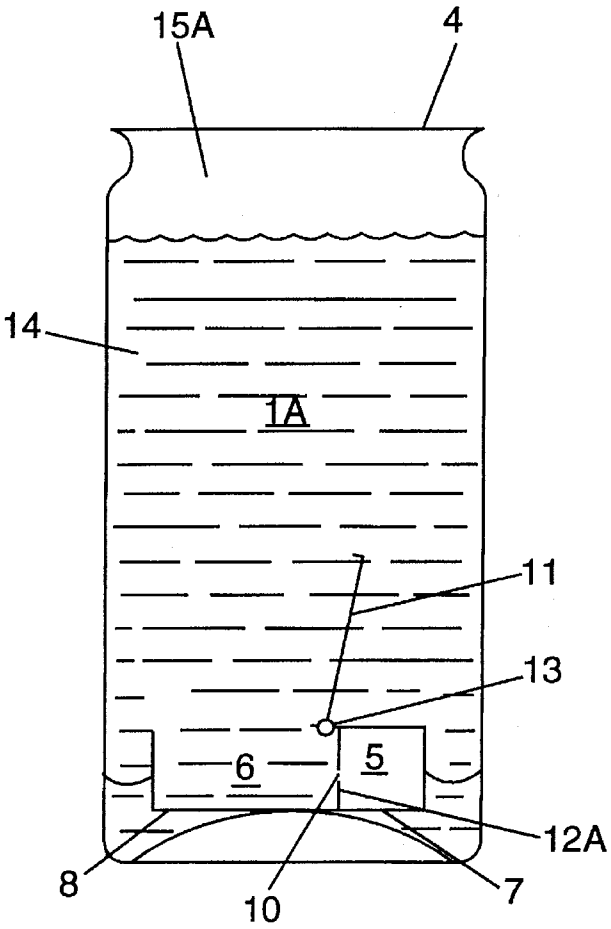
Figure 8:
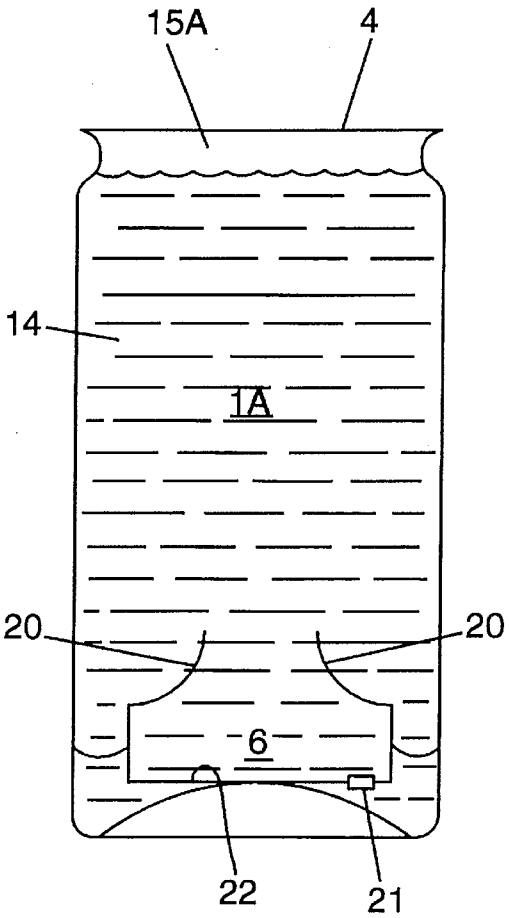
Figure 7:
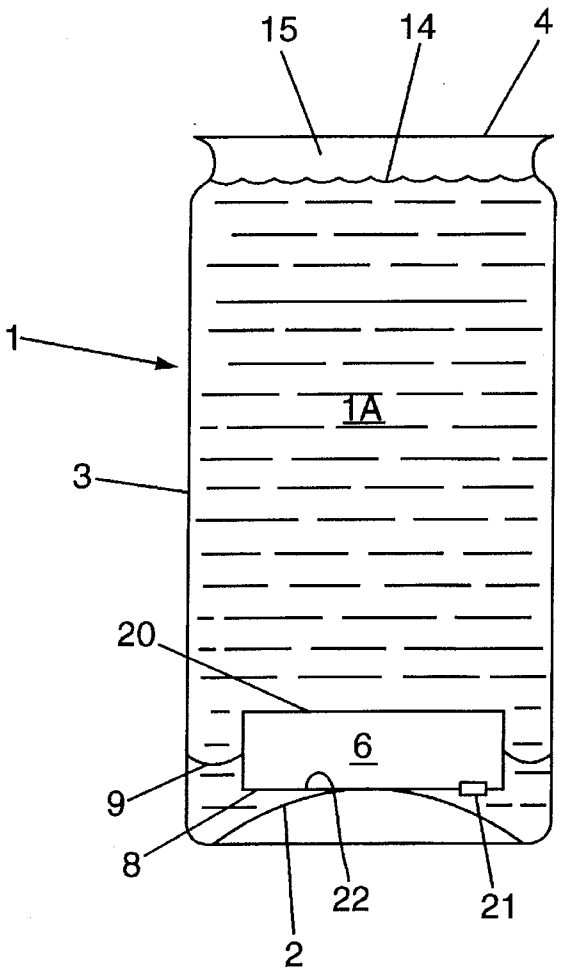

The illustrated embodiments will be considered in relation to beverage packages in which beer, such as stout or lager, is packaged in a conventional, generally cylindrical can 1 having a primary chamber 1A formed by a domed base 2, a cylindrical side wall 3 and an openable top 4. The beer which is to be packaged contains nitrogen gas in solution and such gas is to be intentionally liberated on opening of the package for consumption of the beer. In the embodiments of FIGS. 1 to 6 the gas liberation is achieved internally of the container, by the automatic injection into the beer of a jet of gas and/or liquid in response to a pressure differential which is developed by the opening of the package so that such injection liberates the gas in solution to create a froth or foam in a headspace. In the embodiment of FIGS. 7 and 8 the gas liberation is achieved externally of the container when opened, for example by ultrasonic stimulation or injection of gas or liquid from a syringe. Conveniently the beer and the techniques for froth or foam development are substantially as disclosed in our British Patent Specifications 2,183,592A and 1,588,624 for FIGS. 1 to 6 and FIGS. 7 and 8 respectively and as such need not be discussed in detail herein.

Prior to its top 4 being fitted, the can 1 is displaced along a conventional beer filling line in an upstanding condition to provide an open top. The can is purged of air with nitrogen gas and receives through its open top a relief chamber 6 and, in the embodiments of FIGS. 1 to 6, a secondary chamber 5. The chambers 5 and 6 are formed by plastics moulded inserts or insert parts 7 and 8 respectively and are located on or towards the bottom 2 of the can 1. The inserts are retained in the can, conveniently, by flanges 9 which form a friction or interference fit with the side wall 3 of the can (although it will be appreciated that alternative forms of retention can be used such as magnetic or by suction cup). The inserts 7 and 8 in FIGS. 1 to 4 may be moulded independently of each other and conveniently such independent mouldings are coupled together for simultaneous location within the can as a unified insert structure. Alternatively the secondary and relief chambers 5, 6 may be formed, predominantly, as a single moulding, particularly in FIGS. 5 and 6, for insertion into the container.

The secondary chamber 5 in the embodiments of FIGS. 1 to 6 communicates, or is to communicate, with beverage in or derived from the primary chamber 1A of the can by way of a restricted aperture or orifice 10 in the wall of its insert part 7 and this chamber 5 and orifice 10 are provided for the purpose of liberating gas from solution in the beer which is to be packaged in the can in the manner disclosed in G.B.-A-2,183,592.

In FIGS. 1 to 6 the insert part 8 is moulded of heat shrinkable plastics and includes a cap 11 which defines the relief chamber 6 with a wall 12 of the insert part 8. The cap 11 is secured to the wall part 12 by an integral hinge 13. As received by the can 1, the cap 11 is in sealed engagement with the wall part 12 to seal the relief chamber 6 and this chamber will have been purged of air and sealed to accommodate nitrogen gas under pressure of, say, 3 bar. The secondary chamber 5 will also be purged of air and accommodate nitrogen gas—this purging and gasifying may have occurred prior to the insert part 7 for the secondary chamber being received by the can 1 or while that chamber is located within the can 1.

The open top can with its insert(s) 7, 8 fitted, passes to a filling station in which it is charged with a required measure of the beer 14 to provide a relatively small headspace 15. The can and its beer content passes along the packaging line to a sealing station where the lid or top 4 is fitted to the open top of the can and sealed by seaming in conventional manner to a mouth presented by the side wall 3. Prior to and during fitting of the can top 4, nitrogen gas under pressure is directed into and over the small headspace 15 to ensure that the headspace is purged of atmospheric oxygen and to alleviate the entry of air into the headspace.

Figure 2:
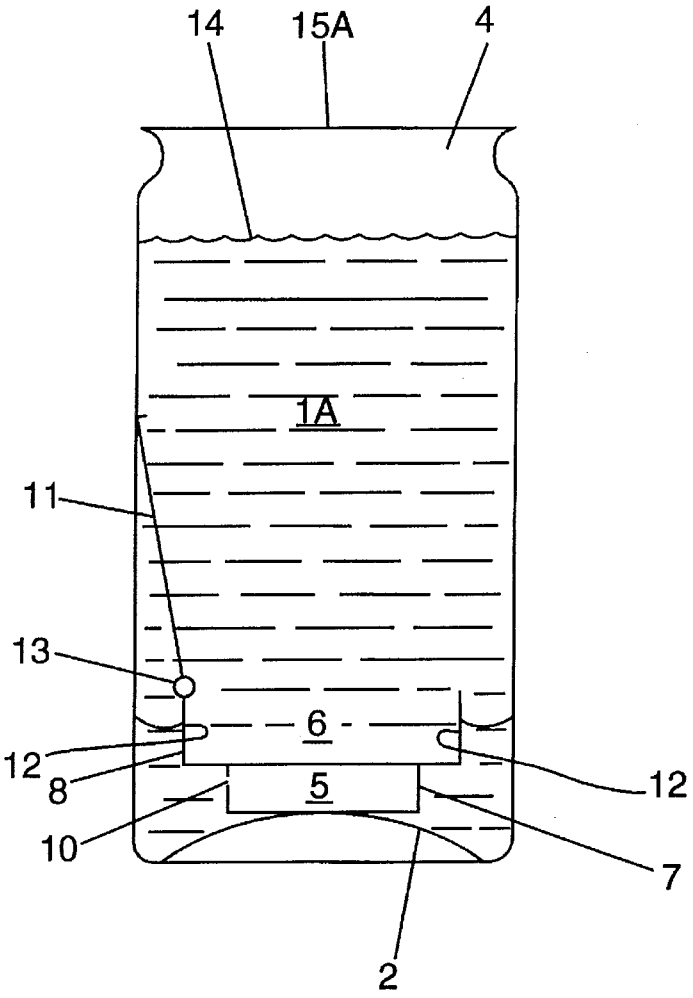
Figure 4:
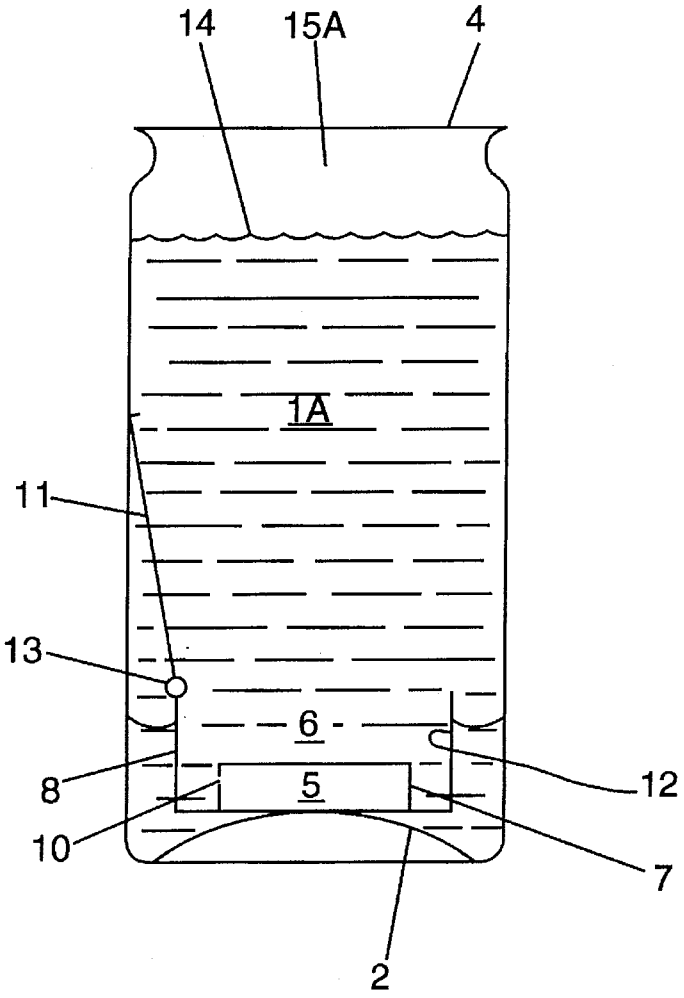

Following sealing of the can 1, the beverage package thus formed is subjected to a pasteurisation process. As a result of the heat to which the package is subjected during pasteurisation the plastics material of the insert part 8 for the relief chamber 6 undergoes a transformation or deformation. This deformation causes the cap 11 to disengage from its sealed contact with the wall part 12 (and possibly causes a plastics retaining linkage, not shown, which retains the cap to break) and allows the cap to pivot on the integral hinge 13 in a sense to open the relief chamber 6 to communication with the primary chamber 1A and the beer therein. The small headspace 15 contains nitrogen gas at relatively low pressure, say 1.3 bar, imparted during the can sealing stage while the relief chamber 6 contains nitrogen gas under relatively high pressure. Therefore the cap 11 may be subjected to a considerable pressure differential between the nitrogen pressure within the relief chamber and the fluid pressure on the outside of that chamber which causes the cap to pivot to a fully open condition as shown in FIGS. 2, 4 and 6 while still being retained on the insert part 8 by the integral hinge. Furthermore, the integral hinge 13 may be structured to bias the cap 11 towards and maintain it in its fully open condition. As the nitrogen gas under pressure from the relief chamber 6 is released from that chamber and into the beer 14 in the primary chamber 1A and the headspace of that chamber, beer from the primary chamber 1A flows into and fills the relief chamber 6. As a consequence the headspace in the primary chamber 1A is enlarged as shown at 15A in FIGS. 2, 4, 6 and 8. In a typical example, the beer can 1 may have a nominal capacity of 500 milliliters and accommodate 450 milliliters of beer and the inserts are arranged so that the small headspace 15 will have a volume and depth in the order of 30 milliliters and 8 millimeters respectively while the enlarged headspace 15A will have a volume and depth in the order of 66 milliliters and 20 millimeters respectively.

Figure 1:
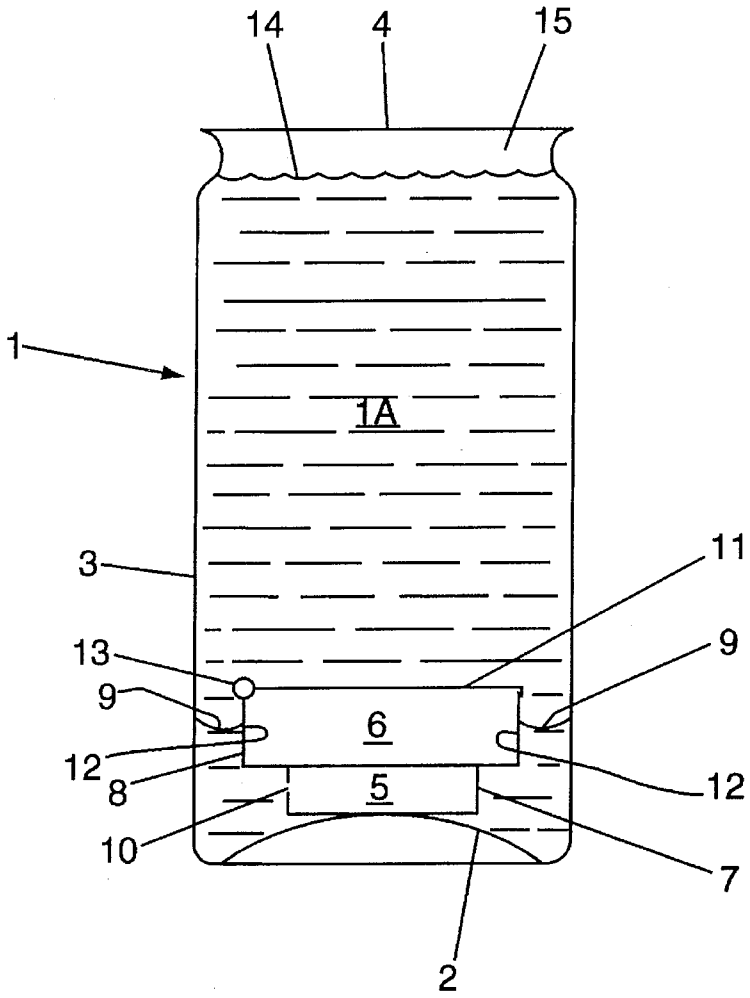

In the embodiment of FIGS. 1 and 2 the nitrogen gas which is released from the relief chamber 6 pressurises the contents of the can including the secondary chamber 5 through the restricted orifice 10 in a similar manner to the disclosure in G.B.-A-2,183,592. As a consequence, when the sealed can is opened, typically by piercing, tearing off or displacing a portion of the can top 4 in conventional manner, for dispensing and consumption of the beer 14, the headspace 15A communicates with atmospheric pressure; this creates a pressure differential between that in the secondary chamber 5 and the beer 14 in the primary chamber 1A. Resulting from this pressure differential, gas and/or beer is displaced under pressure from the secondary chamber 5 and by way of the restricted orifice 10 to be jetted into the beer in the primary chamber 1A causing gas in solution in the beer to be liberated for the development of froth or foam in the headspace 15A in a manner which is now well known in the art.

The enlargement of the headspace 15A will usually be adequate to accommodate the froth or foam which is developed or to accommodate sufficient froth or foam which is developed in a reasonable time to permit the beverage to be consumed or poured into a drinking vessel without wastage of the beverage bubbling from the opening in the top 4 of the can. It will be noted from the Figures that the cap 11 is displaced sufficiently from the open relief chamber to ensure that when the beer is poured from the can the relief chamber 6 can be emptied of beer along with the primary chamber 1A.

Figure 3:
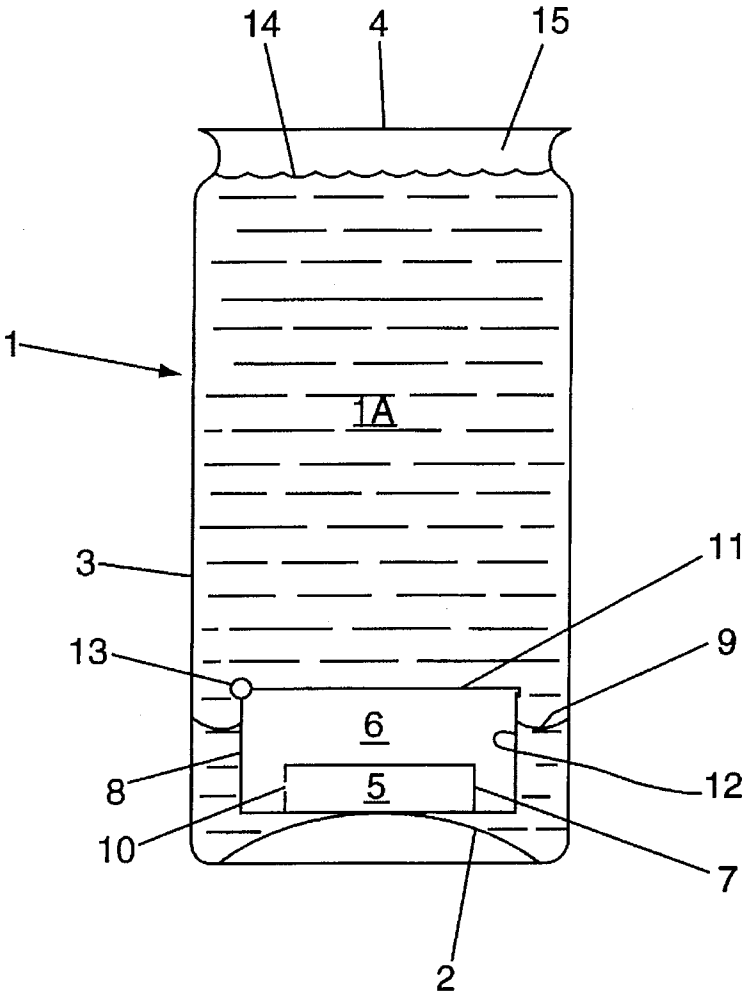
Figure 5:
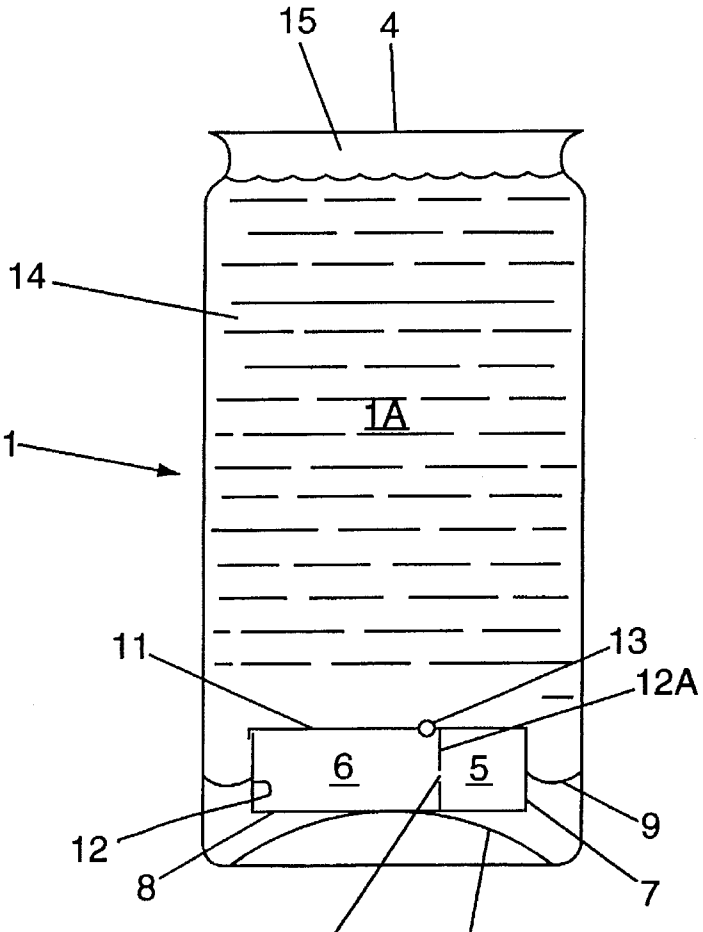

In the embodiments shown in FIGS. 3 and 4 and in FIGS. 5 and 6 the secondary chamber 5 is located so that it communicates by way of the restricted orifice 10 with beverage which will be received in the relief chamber 6. In FIGS. 3 and 4 the insert part 7 for the secondary chamber 5 is located within the insert part 8 for the relief chamber 6 and similarly to the embodiment of FIGS. 1 and 2, the insert parts 7 and 8 may be moulded independently or integral with each other. In FIGS. 5 and 6 the insert part 7 for the secondary chamber 5 is structured externally of the relief chamber 6 and is arranged so that the orifice 10 of the secondary chamber 5 communicates with the relief chamber 6 in a partition wall 12A between those chambers; in this arrangement the insert parts 7 and 8 are preferably moulded integrally. A particular advantage of the insert arrangement shown in FIGS. 3 and 5 is that prior to location of the independent or unified insert parts 7 and 8 in the can 1, the secondary and relief chambers 5 and 6 can be degassified or purged of air and pressurised with nitrogen gas under pressure simultaneously so that this nitrogen gas pressure is maintained in both chambers 5 and 6 when the cap 11 is closed to seal the relief chamber 6. This degassing and pressurisation of the chambers 5 and 6 simultaneously can be effected at a position remote from the packaging line so that the composite pressurised insert can be supplied and located within the open topped can in a relatively simple manner on a conventional beer filling line. Following fitting of the composite insert as shown in FIGS. 3 and 5, the can is processed to complete the beer package and subjected to pasteurisation which causes the cap 11 to open the relief chamber 6 as shown in FIGS. 4 and 6 and in a similar manner to the embodiment of FIG. 2. The nitrogen gas under pressure released upon opening of the relief chamber 6 pressurises the contents of the can as the enlarged headspace 15A is developed. However, in the embodiments of FIGS. 3 to 6 because the secondary chamber 5 contains nitrogen gas substantially at the same pressure as that originally in the relief chamber 6, the entry of beer into the secondary chamber 5 will be alleviated as the contents of the can come into equilibrium. Consequently when the top of the can is opened for consumption of the beer, nitrogen gas under pressure from the secondary chamber 5 will predominantly be injected by way of the restricted orifice 10 into the beer in the relief chamber 6 for the purpose of liberating gas in solution from the beer and the development of froth or foam. The predominant injection of gas into the beer for the development of froth may, for some beverages, be preferred to liquid injection.

It will be appreciated that the sealed composite insert shown in FIG. 3 or in FIG. 5 as supplied to the can will alleviate the possibility of either the secondary chamber 5 or the relief chamber 6 being contaminated with atmospheric oxygen either during the storage of the composite insert or its transfer to a can in the packaging line.

In the embodiment shown in FIGS. 7 and 8 the hollow insert 8 for the relief chamber 6 has a top closure in the form of a burst sheet, conveniently of disc shape, 20. A non-return valve 21 is located in a bottom wall 22 of the insert 8 to permit communication, in response to an appropriate pressure differential, in a direction from the primary chamber 1A into the relief chamber 6. Following beer charging and sealing, the can 1 is subjected to pasteurisation for which purpose it is inverted, in accordance with conventional practice, prior to being heated. Upon inversion the non-return valve 21 communicates with the small headspace 15 and in response to the heat applied during pasteurisation, the gas pressure in the headspace 15 increases at a greater rate than that in the relief valve 6. This causes the non-return valve 21 to open and maintain the pressure in the relief chamber 6 in equilibrium with that in the small headspace 15. Upon cooling the can following pasteurisation, either with the can upright or inverted, the gas pressure in the relief chamber 6 decreases at a slower rate than the gas pressure in the small headspace 15. As a consequence the sheet 20 is subjected to a pressure differential causing it to burst outwardly of the insert 8 as shown in FIG. 8. The open insert 8 now receives beer from the primary chamber 1A to provide the enlarged headspace 15A. When the can top 4 is opened for consumption of the beer, gas in solution in the beer may be liberated for developing froth or foam in the enlarged headspace by ultrasonic stimulation or otherwise as discussed in our British Patent No. 1,588,624. The burst sheet 20 may be moulded in a heat shrink plastics material and designed so that when subjected to the heat of pasteurisation the structure of the sheet is weakened adequately to ensure that it will burst in response to the pressure differential to which it will subsequently be subjected.

Although the present invention has been discussed in relation to a container in the form of a can, it will be appreciated that the invention may be utilised with other forms of containers such as glass or plastics bottles and cartons.

I claim:

1. A beverage package comprising a sealed container having a primary chamber accommodating beverage having gas in solution; froth developing means responsive to opening of the container to liberate gas from solution in the beverage and provide froth in a headspace of the primary chamber; a relief chamber which is closed to communication with the beverage in the primary chamber when the container is sealed and is openable subsequent to said sealing, and means for opening said relief chamber prior to opening of the sealed container whereby, on opening of said relief chamber, a portion of beverage derived from the primary chamber is accommodated in the relief chamber to enlarge said headspace for accommodating froth developed therein on subsequent opening of the sealed container wherein the relief chamber initially and prior to being opened contains gas under pressure greater than atmospheric and when opened to accommodate beverage, said gas in the relief chamber is released to pass through the beverage and increase pressure in the enlarged head space which is then developed in the primary chamber.

2. A package as claimed in claim 1 in which the relief chamber is formed by a hollow insert located and retained at a predetermined position within the container.

3. A package as claimed in claim 1 in which the container is sealed and in which the relief chamber has been opened subsequent to sealing to accommodate beverage derived from the primary chamber.

4. A package as claimed in claim 1 in which the relief chamber is arranged to open to accommodate beverage from the primary chamber so that such beverage accommodated by the relief chamber will be dispensed from the container together with beverage from the primary chamber when the container is opened.

5. A package as claimed in claim 1 in which the means for opening the relief chamber comprises a closure arranged to respond to treatment of the package with the container sealed so that the relief chamber is caused to open.

6. A package as claimed in claim 5 in which the closure is arranged to open the relief chamber in response to heat applied to the package.

7. A package as claimed in claim 5 in which the closure is arranged to open the relief chamber in response to a pressure differential created by said treatment between pressure of gas within the relief chamber and a relatively lower pressure in the primary chamber externally of the relief chamber.

8. A package as claimed in claim 5 in which the closure comprises a cap which is displaced from a condition in which it seals the relief chamber to a condition in which the relief chamber is opened to the primary chamber.

9. A package as claimed in claim 8 in which the cap is hingedly mounted to be retained by said mounting within the container.

10. A package as claimed in claim 7 in which the closure comprises a sheet which is intended to burst in response to said pressure differential so that the burst sheet will open outwardly of the relief chamber to provide communication between the relief and primary chambers.

11. A package as claimed in claim 1 in which the relief chamber is formed to include plastics material, the dimensions of which undergo a change in response to heat applied thereto and which change is arranged so that the relief chamber will open to communication with the primary chamber.

12. A package as claimed in claim 1 in which the relief chamber comprises a non-return valve which opens to provide communication between the primary chamber and the relief chamber solely in response to a pressure differential created by pressure in the primary chamber being greater than pressure in the relief chamber.

13. A package as claimed in claim 1 in which said froth developing means is responsive to a pressure differential created by the opening of the sealed container for liberating gas from solution in the beverage to form froth in the headspace of the primary chamber.

14. A package as claimed in claimed 3 in which the froth developing means comprises a secondary chamber from which secondary chamber at least one of liquid and gas is injected into the beverage for effecting said liberation of gas from solution on opening of the sealed container.

15. A package as claimed in claim 14 in which the secondary chamber is located to provide said injection into beverage in the primary chamber.

16. A package as claimed in claim 14 in which said secondary chamber is arranged to provide said injection into beverage accommodated by the relief chamber when said relief chamber has opened to communication with the primary chamber.

17. A package as claimed in claim 16 in which the openable relief chamber is closed to communication with the primary chamber and closure of the relief chamber closes communication between the secondary chamber and the primary chamber.

18. A package as claimed in claim 17 in which the secondary chamber communicates with the relief chamber by way of a restricted orifice and wherein said relief and secondary chambers contain gas at substantially equal pressure.

19. A package as claimed in claim 14 in which the secondary chamber is formed as a hollow insert part located and secured within the container.

20. A package as claimed in claim 19 in which the relief chamber comprises a further hollow insert part which is coupled to the insert part of the secondary chamber to provide a unified insert structure.

21. A package as claimed in claim 16 in which the secondary chamber is located within the relief chamber.

* * * * *

UNITED STATES PATENT AND TRADEMARK OFFICE

CERTIFICATE OF CORRECTION

PATENT NO. : 5,474,788

DATED : December 12, 1995

INVENTOR(S) : Francis J. Lynch

It is certified that error appears in the above-indentified patent and that said Letters Patent is hereby corrected as shown below:

Title page,
item [30] "Foreign Application Priority Data:

Delete "9213914" and substitute--9213914.6--.

Signed and Sealed this

Fourth Day of June, 1996

Bruce Lehman

*Attest:*

BRUCE LEHMAN

*Attesting Officer*

*Commissioner of Patents and Trademarks*